US006372063B1

(12) United States Patent
Grillon

(10) Patent No.: US 6,372,063 B1
(45) Date of Patent: Apr. 16, 2002

(54) PROCESS FOR MANUFACTURING METALLIC COMPONENT AND SUCH METALLIC COMPONENT

(75) Inventor: Gilles Grillon, Royat (FR)

(73) Assignee: Michelin Recherche et Technique, S.A. (CH)

( * ) Notice: Subject to any disclaimer, the term of this patent is extended or adjusted under 35 U.S.C. 154(b) by 127 days.

(21) Appl. No.: 09/589,791

(22) Filed: Jun. 8, 2000

(30) Foreign Application Priority Data

Jun. 8, 1999 (FR) ..... 99 07519

(51) Int. Cl.[7] ..... C21D 7/06; C21D 8/00; C22C 21/00

(52) U.S. Cl. ..... 148/552; 148/538; 148/546; 148/547; 148/555; 148/557; 148/671; 148/674; 148/677; 148/697; 148/705; 148/706; 148/707; 148/654; 148/320; 148/420; 148/421; 148/423; 148/425; 148/426; 148/430; 148/437; 148/441; 148/442; 29/90.7

(58) Field of Search ..... 148/538, 546, 148/547, 555, 557, 671, 674, 677, 697, 705, 706, 707, 654, 320, 420, 421, 423, 425, 426, 430, 437, 441, 442; 29/90.7

(56) References Cited

U.S. PATENT DOCUMENTS 5,729,883 A 3/1998 Yoshioka et al.
5,900,080 A 5/1999 Baldi et al.

FOREIGN PATENT DOCUMENTS

EP 0905266 3/1999

*Primary Examiner*—Deborah Yee
(74) *Attorney, Agent, or Firm*—Baker Botts LLP

(57) ABSTRACT

The process for manufacturing a metallic component, such as a wheel part for the rolling system of a vehicle, which includes, in an initial stage, forming the component of a metallic material in a semi-solid state and having a thixotropic structure, and in a subsequent cold-treatment stage, cold-treating at least part of said component by blasting it with projectiles with a view to plastic deformation thereof. A wheel in which a metallic disk is welded to a wheel rim and in which the metallic disk is obtained by the manufacturing process.

18 Claims, 3 Drawing Sheets

PROCESS FOR MANUFACTURING METALLIC COMPONENT AND SUCH METALLIC COMPONENT

BACKGROUND OF THE INVENTION

The present invention relates to a process for manufacturing a metallic component, such as a wheel part for the rolling system of a vehicle, and to such a wheel. The invention relates in particular to a metallic wheel part, such as a wheel disk, made of a light metal, such as aluminum, magnesium or a metal allowing a substantial reduction in weight, such as titanium, or indeed which consists of an alloy of one of these metals.

Wheel disks made of a metallic alloy, such as aluminum, are conventionally manufactured by a forging process or a casting process.

The first of the above-stated processes, although generally producing disks exhibiting satisfactory mechanical and aesthetic properties, has the major disadvantage of entailing high implementation costs.

For several years, preference has been given to the second of the above-stated processes, using a material consisting of an alloy previously converted into a thixotropic, semi-solid metallographic state. This thixotropic state may be characterized by an alloy structure which comprises a non-dendritic primary phase, consisting of globules or nodules substantially spherical in form.

For a description of such a casting process using a thixotropic, semi-solid alloy and of a die for performing this process, reference may be made, for example, to European patent EP-A-710 515.

Reference may also be made to European patent EP-A-439 981 for a description of a method of achieving the above-mentioned thixotropic state.

This forming process is often designated by the generic term "thixoforming", which includes both the principle of die casting (known as "thixocasting") and the principle of casting/forging on a vertical machine (known as "thixoforging").

Wheel disks formed by this casting process have, in particular, the following advantages, owing precisely to the above-mentioned metallographic state of the alloy, which may be defined by small globules (generally smaller than 120 $\mu$m) and distributed in a virtually uniform manner.

These disks may be thinner and consequently lighter than disks obtained from alloys cast in a different state.

Moreover, they are less porous, which results in uniform, improved density and mechanical strength and also in an improved capacity for heat treatment.

This forming process exhibits other advantages, in particular:

- a wide range of options with regard to the aesthetic appearance of the wheel disks obtained (with, for example, the possibility of achieving thin walls or considerable variations in section),
- a good dimensional precision with regard to the disks obtained, which minimizes machining operations,
- high productivity as a result of short cycle times and automation of tasks, and a substantially increased die service life in comparison with that of dies used in conventional processes for injection die casting of liquid metals, such as aluminum.

SUMMARY OF THE INVENTION

The object of the present invention is to propose a process for manufacturing a metallic component which consists, in an initial stage, in forming said component of a metallic material in a semi-solid state and having a thixotropic structure, such that said component exhibits better mechanical and weight reduction properties than those stated above.

To this end, the manufacturing process according to the invention includes, in a subsequent cold-treatment stage, in cold-treating at least part of said component by blasting it with projectiles with a view to plastic deformation thereof.

According to one variant of the invention, this manufacturing process includes, in a stage after said initial stage and before said subsequent stage, in subjecting said formed component to structural hardening.

According to a particular embodiment of the invention, said process further includes subjecting said formed component to an intermediate die forging stage after said initial stage, before performing said structural hardening stage.

The process preferably uses, to perform said initial forming stage, an alloy based on a metal belonging to the group comprising aluminum, magnesium, titanium, iron, chromium, cobalt, nickel, copper, zinc, silver, tin, lead and antimony.

Use is advantageously made of an aluminum-based alloy, such as an alloy additionally comprising between 6.5 and 7.5% by weight of silicon and between 0.5 and 0.6% by weight of magnesium.

Such an aluminum-based alloy has the advantage of minimizing corrosion.

According to another feature of the invention, said initial forming stage comprises thixoforming, which may consist of either thixocasting or rheocasting.

It should be noted that the thixocasting process comprises a first stage of filling a die with semi-solid thixotropic metallic material and a second stage of compacting said material under elevated pressure in the die, for example of the order of 100 MPa.

It should also be noted that, in a known manner, the process known as "rheocasting" essentially comprises mechanical agitation of a liquid alloy to obtain a semi-solid state, then direct casting of the semi-solid alloy obtained, without said casting being preceded by any cooling stage.

According to a further feature of the invention, the structural hardening stage of said process comprises quenching followed by annealing.

According to an exemplary embodiment of the process according to the invention, at least one operation of said cold-treatment stage uses as said projectiles corundum grains between 75 and 150 $\mu$m in size.

According to another example of the invention, at least one operation of said cold-treatment stage uses glass microspheres as said projectiles.

According to another example of the invention, at least one operation of said cold-treatment stage uses as said projectiles steel or cast iron pellets between 200 and 800 $\mu$m in size.

According to an advantageous feature of the invention, said initial forming stage includes forming a wheel for the rolling system of a vehicle, said wheel comprising a wheel disk and a wheel rim, in such a way that said wheel constitutes said manufactured metallic component and said cold-treatment stage is carried out by blasting with said projectiles all or part of at least one face of said disk and/or said rim.

According to an equally advantageous variant, said initial forming stage consists in forming part of a wheel for the rolling system of a vehicle, said part of a wheel comprising a wheel disk or a wheel rim, in such a way that said wheel part constitutes said manufactured metallic component and said colt-treatment stage is carried out by blasting with said projectiles all or part of at least one face of said disk or said rim.

According to an equally advantageous variant, said initial forming stage consists in forming part of a wheel for the rolling system of a vehicle, said part of a wheel comprising a wheel disk or a wheel rim, in such a way that said wheel part constitutes said manufactured metallic component and said cold-treatment stage is carried out by blasting with said projectiles all or part of at least one face of said disk or said rim.

A wheel according to the invention for a vehicle rolling system, which comprises a wheel rim to which there is fixed, for example by welding, a metallic disk, is such that said metallic disk is obtained by a manufacturing process described above.

The aforementioned features of the present invention, together with others, will be better understood from a reading of the following description of an exemplary embodiment of the invention, given by way of non-limiting example, said description being made with reference to the accompanying drawings.

DESCRIPTION OF PREFERRED EMBODIMENTS

Figure 1A:
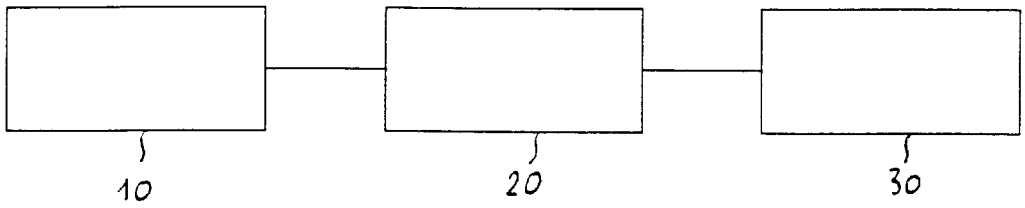
FIGS. 1*a* and 1*b* are block diagrams illustrating a process for manufacturing a metallic component, respectively, in accordance with two different embodiments of the invention.

With reference to FIG. 1*a*, a process for manufacturing a metallic component according to a first embodiment of the invention includes, in a first stage 10, forming said component by thixocasting a metallic material in a semi-solid state and having a thixotropic structure, then, in a second, optional stage 20, subjecting said formed component to structural hardening, then, in a third stage 30, blasting at least part of said component with projectiles.

Figure 1B:
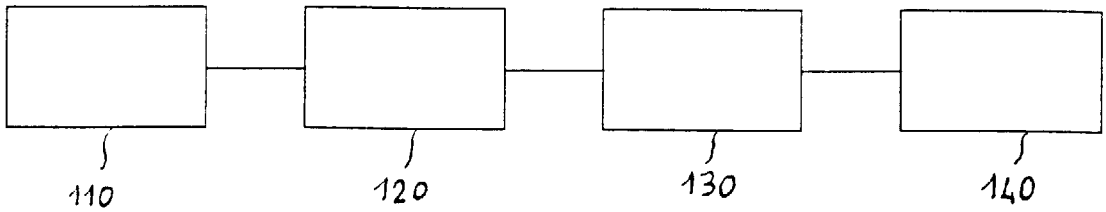

With reference to FIG. 1*b*, it may be seen that a second embodiment of the process according to the invention includes in performing a first stage 110 identical or similar to the aforesaid stage 10, then performing a second stage 120 of die forging the component thus formed, then performing an optional third, structural hardening stage 130 different from said stage 20, then performing a fourth, projectile-blasting cold-treatment stage 140 identical or similar to said stage 30.

To perform the first stage 10 or 110, cylindrical bars of predetermined length or slugs, consisting, for example, of a light metal-based aluminum or magnesium-based alloy, are injected into a die (not shown, since it is as described in European Patent EP-A-710 515).

An aluminum-based alloy is advantageously used. Preferably, said alloy is an alloy belonging to the aluminum/silicon family.

Even more preferentially, said alloy bears the name A-S7G0.6, in accordance with standard NF A 02-004, such that it comprises, in addition to aluminum and in percentages by weight, in particular:

between 6.5% and 7.5% silicon;
0.15% iron;
0.03% cooper,
0.03% manganese,
0.60% magnesium;
0.03% nickel;
0.05% zinc;
0.03% lead and tin;
0.20% titanium;
0.05% strontium.

In the rest of the present description, this alloy A-S7G0.6 will be referred to on the one hand in relation to the description of the second embodiment and on the other hand in relation to the mechanical strength and weight reduction results obtained by performing said first or said second embodiment.

Upstream of said die, the metallic alloy to be injected has previously been converted in a first period into a thixotropic metallographic structure and in a second period into a semi-solid state.

More precisely, said first period comprises, for example, subjecting billets of said alloy to agitation by electromagnetic induction, in accordance with the process and corresponding device described in European Patent EP-A-439 981, to obtain thixotropic billets.

To ensure in a second period that said thixotropic billets are also in a semi-solid state, induction heating of said billets is then performed to bring them to a temperature T(° C.) such that:

$T_{fe}<T<T_{fe}+10$, where $T_{fe}$ is the eutectic fusion temperature (which is 577° C. for said alloy A-S7G0.6 preferentially used).

It should be noted that the thixotropy of the alloy injected into the die is such that the maximum size of the globules characterizing it is less than 120 $\mu$m.

It should be noted that other processes may be used to obtain a thixotropic structure and semi-solid state. Particular mention may be made of the process known by the person skilled in the art by the name "rheocasting", which consists essentially in agitation of a semi-solid alloy, which may or may not be associated with a process for chemically refining the dendritic grains.

At the time of the casting operation, which proceeds in accordance with said European Patent EP-A-710 515, it should be noted that the material injected into the die is finally compacted under a pressure of the order, for example, of 100 MPa (the compaction pressure value may vary as a function of the alloy and process used).

The cast material is allowed to cool until a solid state is obtained and then demolded immediately. A metallic component is thus obtained which is formed in accordance with the die cavity.

In accordance with said second (optional) stage 20 of this first embodiment of the process according to the invention, structural hardening successively comprising quenching of said component and annealing thereof is performed preferably immediately after said demolding. It should be noted that this structural hardening may be omitted.

During said quenching, which is performed using a suitable fluid such as water and which lasts for several seconds, said fluid is maintained at a temperature of between 30 and 60° C., preferably between 30 and 40° C.

Said annealing is performed at a temperature of 170° C. for 6 hours.

It should be noted that the treatment temperature and duration parameters used for structural hardening of a component are so adapted as to obtain a specific interrelationship between strength and ductility.

In accordance with the third stage 30 of said first embodiment of the invention, the metallic component obtained after the second stage 20 is treated by cold plastic deformation, blasting it with projectiles at ambient temperature.

Figure 2:
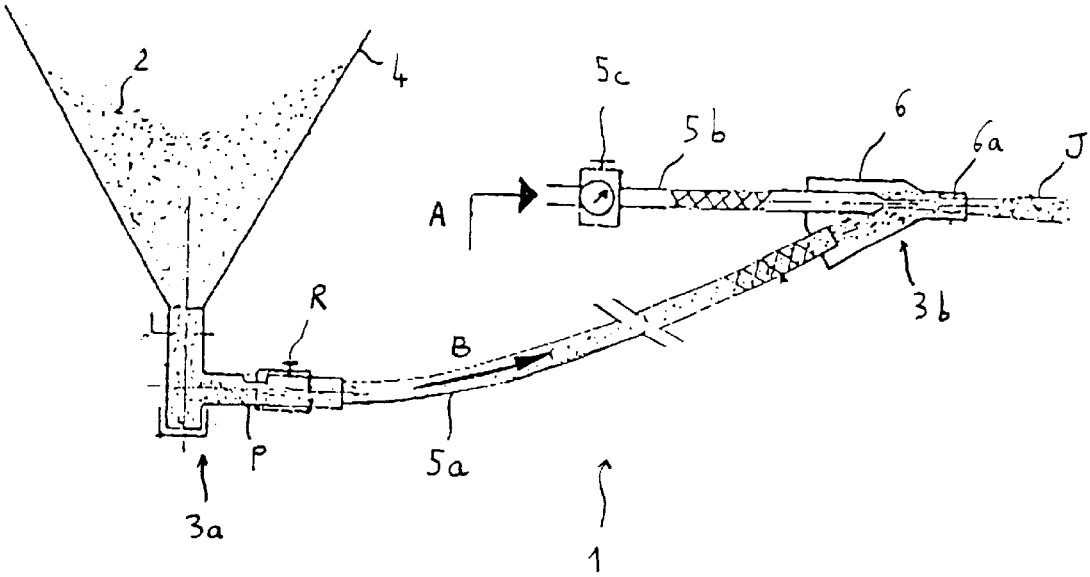
FIG. 2 is a schematic view of a device for emitting projectiles for performing said manufacturing process according to the invention.

This projectile blasting is achieved, for example, by a device 1 for emitting projectiles 2, the structure of which is shown in simplified manner in FIG. 2.

This device 1 comprises at least one inlet 3*a* connected upstream to a storage hopper 4 for the projectiles and at least one outlet 3*b* for emitting jets J.

In the example shown in FIG. 2, the device 1 is of the type which sucks in the air contained in the hopper 4 so as to create a depression therein, and it is known by the name "Giffard".

More precisely, the device 1 shown in this exemplary embodiment comprises a first hose 5*a*, the ends of which form respectively the inlet 3*a* and the outlet 3*b*. The inlet 3*a* is connected to the lower part of the hopper 4, and it comprises an air intake P provided with a control means R for controlling the flow of sucked-in air.

A second hose 5*b* for transporting compressed air (arrow A) is connected to said outlet 3*b* upstream thereof. The air transported by this hose 5*b* is intended to project through said outlet 3*b* the projectiles continuously extracted from the bottom of the hopper 4 (arrow B), by subjecting said hopper 4 to a partial vacuum. A regulator 5*c* for regulating the flow of compressed air and, consequently, the projection rate of the grains, is mounted on said hose 5*b*.

The outlet 3*b* of the hose 5*a* and the downstream end of said hose 5*b* open in leak-proof manner in a gun 6 ending in a projection nozzle 6*a* designed to emit said jets J.

It should be noted that it is possible to use a device 1 using a liquid such as water as the propellant fluid instead of air.

It should also be noted that it is possible to use a device 1 other than that shown in FIG. 2, for example of the type creating gravity, overpressure or direct pressure inside the hopper 4 or of the turbine machine type for mechanical projection of the projectiles 2. It is also possible to use a device 1 of the ultrasonic or electromagnetic type to accelerate the particles or cause them to vibrate intensely against the component being treated, or indeed of the explosive type or of the type which generates a laser impulse.

In general, it will be understood that it is possible to use any device to project the projectiles at the surface to be treated, provided that it ensures that the mechanical, thermal and ballistic parameters conform to the nature and intensity of the desired treatment.

Example of Performance of Stage 30, 140

A face 7*a* of a wheel disk 7 (see FIG. 3), the disk 7 being an alloy A-S7G0.6 and constituting said metallic component which has previously been formed in accordance with the casting stage 10, 110, was subjected to the cold-treatment stage 30, 140 using the device 1 described with reference to FIG. 2.

In this example, projectiles 2 of grains of brown corundum (aluminum oxide, in particular titanium-filled were used). More precisely, the composition of the brown corundum used is as follows, expressed in contents by weight:

| | |
|---|---|
| $Al_2O_3$ | 89% to 94% |
| $TiO_2$ | 2% to 4% |
| $SiO_2$ | 0.4% to 1.5% |
| $Fe_2O_3$ | 1.5% to 3.5% |
| CaO + MgO | 0.3% to 0.5% |
| $Na_2O + K_2O$ | 0.01% to 0.02% |
| magnetic fractions | less than 4% |

The grains 2 exhibited a size of between 75 and 150 $\mu$m and an angular shape.

Furthermore, a compressed air pressure of 4 bar was used to propel the grains 2 through the hose 5*b* and the nozzle 6*a*, a projection direction being selected that was substantially normal to the face 7*a* of the disk 7 to be treated and a projection distance being selected of 100 mm relative to said face 1*a*.

It was sought to characterize the surface state of said face 7*a* of the disk 7 thus blasted with grains 2, and use was made, to this end, of the surface roughness criteria or parameters defined precisely in standard NF/E05-015 (N10*b* surface roughness touch and sight control for Rugotest No. 3 to standard NF/E05-051, registered design).

| Parameter | Control | After blasting |
|---|---|---|
| Ra | 2 $\mu$m | 11 $\mu$m |
| Rt | 40 $\mu$m | 120 $\mu$m |
| Rz | 24 $\mu$m | 94 $\mu$m |
| Rmax | 36 $\mu$m | 111 $\mu$m |

in which
Ra is the arithmetic mean deviation of the profile to be characterized,
Rt is the maximum height of said profile,
Rz is the height of the irregularities at 10 points,
Rmax is the maximum height of the irregularities of said profile.

It should be noted that it is also possible to use other materials and granulometries for said projectiles 2 instead of said brown corundum, for example grains of white corundum (crystallized aluminum oxide) or ceramic material, or dry or wet glass microspheres, or even steel or cast iron pellets of an average size of between 200 and 800 $\mu$m, preferably 400 $\mu$m.

In general, it is possible to use projectiles 2, which may or may not be coated, the material, weight, shape and dimensions of which are suitable for achieving thermomechanical stressing of the surface to be treated in such a way as to subject it to compressive stress of a given degree and depth, and/or for achieving control of the surface state (roughness, folds, for example) and/or for conferring a specified aesthetic appearance on said treated surface (in particular brightness, reflectance, diffuse reflectance, satin effect, color).

It should be noted that this cold-treatment stage 30 involving blasting of projectiles 2 may be performed in one or more operations. In the latter case, the projection conditions, such as speed of the projectiles 2, angle of incidence and rate of coverage are set for each operation so as to achieve the above-stated results.

As far as the second embodiment of the process for manufacturing a metallic component according to the invention is concerned, the second die forging stage 120 which is performed upon completion of casting according to stage 110 is of the type described in European patent EP-A-119 365. More precisely, the core temperature of the demolded component is approximately 450° C. (between 400 and 500° C.) during the die forging operation, that is to say when said cast component is pressed between the two parts of the die.

The third stage 130, involving structural hardening of the cast and die forged component, consists, over a first period, of heating designed to transform the magnesium of said alloy A-S7G0.6 into a substitutional solid in the aluminum, then, over a second period, of quenching followed by annealing as in stage 20 of said first embodiment.

This heating is performed for a period of between 1 and 10 hours, and to a temperature of between 520° C. and 540° C. to achieve the above-stated solid solution.

In this instance, the purpose of quenching is to maintain the magnesium in supersaturated solid solution in the aluminum, while said annealing has the purpose of producing fine precipitation of the magnesium in the aluminum, thereby completing the desired structural hardening.

The fourth stage 140 of this second embodiment is similar to said stage 30 of the first embodiment, as indicated above.

There follow below the results of rotating bending tests (fatigue or endurance limit $L_f$ and relative weight reduction e) obtained for a 15 inch diameter wheel disk 7 consisting of said thixotropic alloy A-S7G0.6, manufactured by performing either said first or said second embodiment of the invention, with the slight difference that a first disk D' according to the invention underwent the blasting treatment of stage 30 or 140 on only one of its faces 7*a* while a second disk D" according to the invention underwent the same blasting treatment on both its faces.

Two "control" disks were taken into account in these experiments.

A first control D1 consisted of a disk of thixotropic structure cast according to the invention, but not blasted as in stage 30 or 140.

A second control D2 consisted of a disk consisting of a refined and forged alloy known by the name 6082T6 (European standard NF EN 573-3), that is to say comprising in particular aluminum, magnesium and silicon, this alloy having been converted into a solid solution, quenched and annealed. As with the first control, this second control was not blast-treated.

The fatigue limit $L_f$ (in MPa) was assessed by performing rotating bending for a number of cycles equal to $6.10^6$.

The relative weight reduction e (in %) was assessed under a breaking load Q imposed for $6.10^6$ cycles (in kilograms of force), in accordance with the equation:

$$e(\%)=100(1-((L_{f1})^{n}/(L_{f2})^{n})),$$

in which, for rotating bending, n=2/3.

All the disks tested D', D", D1 and D2, have the same 15 inch diameter.

Moreover, the thickness of each disk was determined by taking as reference thickness $e_0$ the thickness of a similar reference disk. This reference disk consists of an aluminum-based alloy A-S7G0.3 Y33 to standard NF A/02-004 and was obtained by a "shell casting" process, also known by the person skilled in the art under the name "low-pressure casting". Furthermore, said reference disk is characterized by a fatigue limit $L_{ft}$=105 MPa.

Results:

| | Q at break (kg force) at $6.10^6$ cycles | $L_f$ (MPa) | e (%) |
|---|---|---|---|
| Disk D1 thickness = 0.75 $e_0$ | 705 | 126 | 14.4 |
| Disk 2 thickness = 0.84 $e_0$ | 790 | 119 | 11.0 |
| Disk D' thickness = 0.75 $e_0$ | 820 | 147 | 22.6 |
| Disk D" thickness = 0.75 $e_0$ | 1020 | 183 | 33.3 |

In conclusion, it would appear that the fatigue limit and weight reduction results are markedly better for a disk D' or D" according to the invention than for the control D1 obtained by thixocasting but not blasted and than the control D2 forged but likewise not blasted, this being even more marked for the disk D" taken alone.

Figure 3:
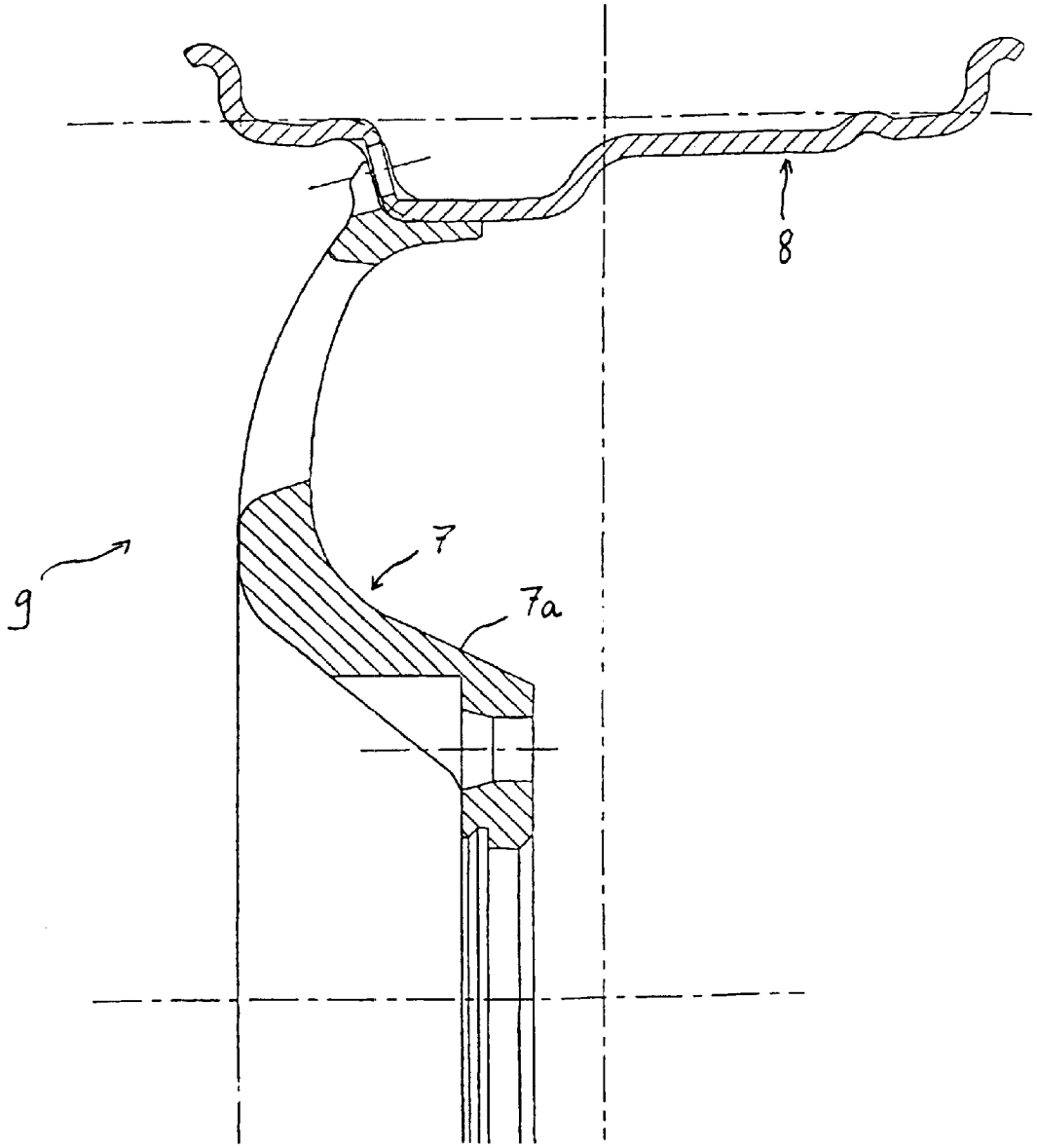
FIG. 3 is a partial, sectional view of a wheel disk and a wheel rim, assembled to form a wheel constituting a metallic component according to the invention.

FIG. 3 shows an example of how a wheel rim 8 may be assembled with a disk 7, constituting an example of a metallic component manufactured by a process according to the invention, to obtain a wheel 9. The wheel rim 8 consists, for example, of a light metal, such as aluminum or magnesium, or of an alloy of such a light metal or indeed of any other known material which might enable the achievement of a satisfactory weight reduction and adequate endurance. This wheel rim 8 may also consist of iron or an iron-based alloy.

This assembly is advantageously performed by a welding process known by the name of MIG, that is to say arc welding using an inert gas shield, such as argon, with metal feed. It should be noted that the thixotropic structure of the disk 7 favors this type of welding.

However, any other method of attaching the disk 7 to the wheel rim 8 is also feasible, for example mechanical fastening.

It should be noted that it is possible to use wheel profiles 9 which differ from that shown in FIG. 3. In particular, it is possible to use a disk profile 7 such as that 20 sold under the name Full Faces™, or a rim profile 8 such as that sold under the name PAX™ or the name Single™ for example.

With regard to the application of the two embodiments of the process for manufacturing a metallic component according to the invention to a wheel 9 for the rolling system of a vehicle, it should be noted that the initial forming stage 10, 110 is not limited solely to the casting of a wheel disk 7, but may also relate to casting of a complete wheel 9 consisting of a disk 7 and a wheel rim 8, in such a way that the component finally obtained by said process consists of said wheel 9. In this case, the cold-treatment stage 30, 140 consists in blasting with projectiles 2 all or part of at least one face 7*a* of the disk 7 and/or of the wheel rim 8.

Still with regard to this application to a wheel 9, it should also be noted that the initial forming stage 10, 110, may consist in forming a wheel rim 8 (that is to say one or other part 7, 8 of a wheel 9) instead of said disk 7, in such a way that the component finally obtained by the process according to the invention consists of the cast wheel rim 8. In this case, as in the case of the disk 7, the cold-treatment stage 30, 140 consists in blasting with projectiles 2 all or part of at least one face of said wheel rim 8.

It should additionally be noted that, in the case of a cold-treatment stage 30, 140 performed in a single operation involving blasting the disk 7 with projectiles 2 on only one of its faces 7*a*, said face 7 may advantageously be the one designed to be positioned on the inside of the wheel 9, owing to the non-smooth appearance of said blasted face 7*a*.

I claim:

1. A process for manufacturing a metallic component, said process comprising, in an initial stage, forming said component of a metallic material in a semi-solid state and having a thixotropic structure, and, in a subsequent cold-treatment stage, cold-treating at least part of said component by blasting it with projectiles to cause plastic deformation thereof.

2. A process for manufacturing a metallic component according to claim 1, including in a stage after said initial stage and before said subsequent stage, subjecting said formed component to structural hardening.

3. A process for manufacturing a metallic component according to claim 2, including subjecting said formed component to an intermediate die forging stage after said initial stage and before performing said structural hardening stage.

4. A process for manufacturing a metallic component according to claim 1, including using, to perform said initial forming stage, an alloy based on a metal belonging to the group consisting of aluminum, magnesium, titanium, iron, chromium, cobalt, nickel, copper, zinc, silver, tin, lead and antimony.

5. A process for manufacturing a metallic component according to claim 4, in which an aluminum-based alloy is used in said initial forming stage.

6. A process for manufacturing a metallic component according to claim 5, in which the aluminum-based alloy is an alloy additionally comprising between 6.5 and 7.5% by weight of silicon and between 0.5 and 0.6% by weight of magnesium.

7. A process for manufacturing a metallic component according to claim 1, in which said initial forming stage comprises thixoforming.

8. A process for manufacturing a metallic component according to claim 7, in which said initial forming stage comprises thixocasting.

9. A process for manufacturing a metallic component according to claim 7, in which said initial forming stage comprises rheocasting.

10. A process for manufacturing a metallic component according to claim 2, in which said structural hardening stage comprises quenching followed by annealing.

11. A process for manufacturing a metallic component according to claim 1, in which at least one operation of said cold-treatment stage includes using as said projectiles corundum grains between 75 and 150 $\mu$m in size.

12. A process for manufacturing a metallic component according to claim 1, in which said cold-treatment stage includes using glass microspheres as said projectiles.

13. A process for manufacturing a metallic component according to claim 1, in which said cold-treatment stage includes using as said projectiles steel or cast iron pellets between 200 and 800 $\mu$m in size.

14. A process for manufacturing a metallic component according to claim 1, in which the metallic component formed in the initial forming stage is a wheel for the rolling system of a vehicle, said wheel comprising a wheel disk and a wheel rim, and in which said cold-treatment stage includes blasting all or part of at least one face of said disk and/or said rim with projectiles.

15. A process for manufacturing a metallic component according to claim 1, in which the metallic component formed in the initial forming stage is a part of a wheel for the rolling system of a vehicle, and in which said cold-treatment stage includes blasting said part with said projectiles.

16. A process as set forth in claim 15, in which said wheel part is a wheel disk.

17. A process as set forth in claim 15, in which said wheel part is a wheel rim.

18. A wheel for the rolling system of a vehicle, said wheel comprising a wheel rim on which there is fixed a metallic disk, characterized in that said metallic disk is obtained by a manufacturing process according to claim 1.

* * * * *